United States Patent [19]

Weible

[11] Patent Number: 5,071,439

[45] Date of Patent: Dec. 10, 1991

[54] PROCESS FOR BLEACHING TEXTILE MATERIAL

[75] Inventor: Karl-Heinz Weible, Aesch, Switzerland

[73] Assignee: Sandoz Ltd., Basle, Switzerland

[21] Appl. No.: 314,690

[22] Filed: Feb. 23, 1989

[30] Foreign Application Priority Data

Feb. 24, 1988 [DE] Fed. Rep. of Germany ..... 3805747

[51] Int. Cl.[5] ..... D06L 3/02

[52] U.S. Cl. ..... 8/111; 8/931; 8/543; 8/650; 435/263

[58] Field of Search ..... 8/111, 931; 252/174.12, 252/95; 435/263

[56] References Cited

U.S. PATENT DOCUMENTS 4,381,247 4/1983 Nakagawa et al. ..... 252/95

4,552,563 12/1985 Dubreux et al. ..... 8/107

OTHER PUBLICATIONS

Gardner, et al., "Cold-Pad Desizing and Bleaching For Dying and Printing", Journal of the Society of Dyers and Colourists. vol. 81, No. 2 Feb. 1965.

*Primary Examiner*—Paul Lieberman

*Assistant Examiner*—John F. McNally

*Attorney, Agent, or Firm*—Gerald D. Sharkin; Richard E. Vila; Thomas C. Doyle

[57] ABSTRACT

A process for bleaching a textile substrate in an aqueous medium, comprising a) applying a peroxide or a peroxide releasing product to the substrate (hereinafter defined as "component a"); and b) destroying excess component a) with a catalase.

36 Claims, No Drawings

PROCESS FOR BLEACHING TEXTILE MATERIAL

The invention relates to a process for bleaching textile material in an aqueous medium.

In order to obtain clear, pure tones on a variety of fibres (particularly on natural fibres), it is necessary to bleach them prior to dyeing. This enables one to obtain a good ground white fibre. From an ecological and technical point of view, hydrogen peroxide, its derivatives and addition products that release peroxide have been used. However, generally, excess peroxide product remains on the fibre and when this occurs it can interfere with and have an adverse affect on subsequent dyeings with anionic dyes for example, direct and/or reactive dyes where the dye is in part or totally destroyed.

To alleviate this problem there is provided a process for bleaching a textile substrate (herein referred to as the Process) in an aqueous medium, comprising a) applying a peroxide or a peroxide releasing product to the substrate (hereinafter defined as "component a"); and b) destroying excess component a) with a catalase.

Preferably the substrate is treated for 30 seconds to 30 minutes with the catalase.

Preferably component a) is selected from hydrogen peroxide, sodium peroxide, sodium perborate and sodium percarbonate.

Preferably the amount of component a) used (calculated on 100% of Component a)) is from 0.5 to 10% based on the weight of substrate to be treated.

Preferred catalases that are suitable for use in a process according to the invention are iron porphyrin-proteides, found naturally occurring in plants and animals. Such catalases are defined in "The Enzymes" by P. D. Boyer 1976—Vol. XIII Part C, pages 363–388 (Academic Press); the contents of which are incorporated herein by reference. Commercially available (and therefore preferred) iron porphyrin-proteides are those derived from cow liver or those derived from penicillium.

Depending on the activity of the catalase and the pH of the liquor used to apply the catalase, preferably the amount of catalase used is from 10 to 100 mg/l, especially about 60 mg/l of liquor used to apply the catalase.

Preferably the process of the invention is carried out in an exhaustion bath having a goods to liquor ratio of from 1:1 to 1:60. Preferably the amount of catalase used is such as to reduce the amount of remaining component a) after bleaching to no more than 10 mg/l in the exhaustion bath. More preferably the amount of catalase used is from 100 thousand to 500 thousand reaction units of enzyme. A "reaction unit" of enzyme is herein defined as that amount of enzyme (in g) required to react with 0.034 mg (one $\mu$mole) of $H_2O_2$ per minute at 25° C. and pH 7.

Bleaching may, however, take place in a continuous or batch process according to known methods. Bleaching baths can be made up of aqueous solutions of component a) optionally together with alkali stabilisers for regulating the release of peroxide, softening agents and/or detergents for washing the material. The bleaching bath may also contain optical brighteners.

If the goods are bleached continuously, they would preferably, after bleaching, be impregnated with a liquor containing the catalase. Depending on bleaching conditions it may be necessary to neutralise the goods prior to application of the catalase. After enzymatically destroying the excess peroxide, the goods can then be dyed.

Bleaching occurs preferably at 60° to 100° C., more preferably 80° to 100° C.

At the end of the bleaching process, when the desired degree of bleaching has been obtained, the catalase enzyme can be added.

This can be done either by adding the catalase to the bleaching bath or by draining the bleaching bath and adding fresh cold water.

If the catalase is added to the bleaching bath, it will generally be advantageous to neutralise the pH (from the high alkaline pH of the bleaching process). The need to do this, however, depends on the catalase used. For example, at pH 10 (and at room temperature) catalase derived from cow liver retains only 50% of the activity that it has at pH7, whereas catalase obtained from penicillium retains 80% activity at comparable conditions. If the same bath is to be used subsequently for dyeing, for example with reactive dyes, it would be advantageous to lower the pH for the dyeing stage so that the rate of uptake of the reactive dye can be controlled and a level dyeing produced.

If, however, the catalase is added after the bleaching bath has been drained and the bath refilled with cold fresh water, such a neutralisation step often will not be necessary.

It is desirable, if the bath is going to be used to dye with dyes that do not give optimal results at the usual bleaching temperatures (80°–100° C.), to reduce the temperature of the bath. This can be done by draining the bath and using fresh water or by adding cold water to the existing bath to bring the temperature of the bath down in order to obtain level dyeings with good take up.

Even when one drains the bath (especially when the modern "short bath" is used), the advantages of the present invention are still present, since the substrate will tend to retain the aqueous peroxide containing medium which, due to its peroxide content, can affect the subsequent dyeing process, and so it is still necessary to destroy the residual excess peroxide.

The following results indicate this point.

Cotton was bleached in a bath having a goods to liquor ratio of 1:10. The initial concentration of peroxide was 1200 mg/l. After bleaching, a residual concentration of 240 mg/l was measured. After draining the bath, it was found that the cotton retained 300 to 400% (of its weight) the aqueous peroxide containing medium. From this, a peroxide concentration of 720–960 mg/kg (based on the weight of substrate) was calculated. After the addition of fresh water at a goods to liquor ratio of 1:10, the peroxide concentration in the bath was still 72–96 mg/l. This value is far too high for dyeing with peroxide sensitive dyes, such as reactive or direct dyes. Indeed, reduced depths of dyeing have been observed with concentrations as low as 9 mg/l of peroxide.

The bleaching process according to the invention is particularly useful for bleaching material that is going to be dyed, with Vat dyes since it alleviates the need to use expensive reducing agent to destroy excess component a) that can interfere with the Vat dyeing. It is also useful for bleaching material to be dyed with reactive and/or direct dyes.

Further, according to the invention, there is provided a method for dyeing a textile substrate (hereinafter referred to as as the method) comprising a) bleaching the substrate with component a) defined above;

b) destroying excess component a) with a catalase; and c) dyeing the substrate with one or more dyes selected from direct dyes, Vat dyes, leuco Vat dyes, sulphur dyes (in reduced or pre-reduced form), coupling dyes, ice dyes, reactive dyes, acid dyes and metal complex dyes.

The dyes can be applied by known methods. Where the dyes are applied using a dyebath, sodium chloride and/or Glauber salt may be used as well as any other dyeing assistants, softening agents, detergents, levelling agents, complex formers or antifoaming agents (as is usually conventional for the particular class of dye used).

It is a particular advantage of the present invention that such dyeings are not adversely effected by the bleaching of the substrate.

The method and process according to the invention can be used for bleaching and dyeing fibrous material selected from the following:

natural and/or regenerated cellulose, preferably cotton optionally mixed with synthetic fibres, for example polyester or polyacrylic fibres;

natural and synthetic polyamide, for example wool, silk, polyamide-6 or polyamide-66, individually or in mixture with each other or cellulose material.

The more preferred textile material that is bleached by a process according to the invention is cotton.

The fibrous material can be in different forms, as loose fibres, yarn, fabric; knitted goods or the finished article.

The method according to the invention is particularly useful for a one bath bleaching and dyeing of cellulosic material, particularly raw cotton.

The invention will now be illustrated by the following Examples in which all parts and percentages are by weight and all temperatures are in °C.

EXAMPLE 1

50 kg of a cotton knitted goods material on a winch beck are bleached in a bleaching bath having the following composition:

4 parts of 40% NaOH
4 parts of 30% $H_2O_2$
0.5 parts of ethoxylated nonylphenol; and
0.5 parts of an organic stabiliser derived from fatty acid ester and magnesium salt;
the balance to 1000 parts being water.

The goods to liquor ratio is 1:20. The cotton material is immersed in the bleaching bath at 40° C., the temperature is raised over 30 minutes to 95° C. and the fabric is bleached at this temperature for a further 30 minutes. The bath is then cooled to 70° C. by the addition of cold water, after which the bath is drained and refilled with cold water to the same volume. The temperature is about 30° C. 60 mg/l of a commercially available catalase derived from cow liver having an activity of 260 thousand reaction units of enzyme (as defined above) are added to this bath. Finally, 20 parts of sodium sulphate in solid form are added. It takes about 10 minutes for this to dissolve. After this has dissolved, the bath is tested for peroxide with a test paper (Merckoquant 10011—from Fa. Merck in the Federal Republic of Germany). No residual peroxide can be detected. Then 0.3% based on the weight of substrate, of C.I. Reactive Red 124 is added to the bath and the temperature is slowly raised to 40° C. 5 g/l $Na_2CO_3$ are added portionswise within 30 minutes and dyeing continued for a further 15 minutes. The bath is then drained, the dyeing is then washed with water and then soaped at the boil with 1 g/l of sodium tripolyphosphate.

A clear, pure, level red dyeing results.

If the process of Example 1 is repeated omitting the catalase, a light pink dyeing results because a large part of the dye is destroyed by the peroxide.

EXAMPLE 2

Bleaching is carried out according to Example 1. After bleaching is terminated, the bath is cooled to 70° C. by the addition of water after which the bath is drained and refilled with cold water to the same volume. 20 Parts of acetic acid are added to neutralize the bath after which the catalase (of Example 1) is added portion by portion over 10 minutes to the neutralised bath. In order to destroy all the peroxide, 30 mg/l of the catalase are required. Finally, 1 part of the sodium salt of o-nitrobenzene sulphonic acid, 16 parts of sodium sulphate and 5 parts of soda are added and the bath is heated to 40° C.

Once 40° C. is reached, 0.5% of C.I. Reactive Blue 41 is added and the bath is heated to 90° C. over 45 minutes. During heating up, 34 parts of sodium sulphate are added and after 90° C. has been reached, 15 parts of soda are added. After 20 minutes, 4 parts of 40% NaOH are added. After a total dyeing time of 75 minutes at 90° C., the bath is cooled to about 70° C. by the addition of cold water, the dyeing is then washed and soaped at the boil.

A clear level blue dyeing results, having a good depth of dyeing.

If the process is repeated without catalase addition, a very light turquoise dyeing results showing that a significant part of the dye has been destroyed.

What is claimed is:

1. A process for bleaching a textile substrate in an aqueous medium which comprises.

i) bleaching the substrate by applying thereto an aqueous solution of a component a) which is a peroxide or a peroxide-releasing product; and ii) after the bleaching, destroying excess component a) by applying a catalase to the substrate.

2. A process according to claim 1, in which component a) is selected from hydrogen peroxide, sodium peroxide, sodium perborate and sodium percarbonate.

3. A process according to claim 1, in which the catalase is an iron porphyrin-proteide.

4. A process according to claim 3, in which the catalase is that derived from cow liver or from penicillin.

5. A process according to claim 1, in which the process is carried out in an exhaustion bath having a goods to liquor ratio of 1:1 to 1:60.

6. A process according to claim 5, in which the amount of catalase used is such as to reduce the residual amount of component a) in the bath to no more than 10 mg/l.

7. A process according to claim 1, in which the catalase is in a liquor and the amount of catalase used is 10–100 mg/l of liquor used to apply the catalase.

8. A process according to claim 1, in which bleaching occurs at 60° to 100° C.

9. A process according to claim 1 wherein the amount of component a) is from 0.5 to 10% based on the weight of the substrate.

10. A process according to claim 1 wherein the bleaching is effected continuously and the substrate is impregnated, after bleaching, with a liquor containing the catalase.

11. A process according to claim 2 wherein the catalase is an iron porphyrin-proteide.

12. A process according to claim 6 wherein the catalase is an iron porphyrin-proteide.

13. A process according to claim 6 wherein the catalase is added to the bleaching bath when the desired degree of bleaching has been obtained.

14. A process according to claim 6 wherein, after the desired degree of bleaching has been obtained, the bleaching bath is drained and fresh cold water is added to the bath and then the catalase is added to the bath.

15. A process according to claim 7 wherein component a) is selected from hydrogen peroxide, sodium peroxide, sodium perborate and sodium percarbonate and the catalase is an iron porphyrin-proteide.

16. A process according to claim 1 wherein the catalase is an iron porphyrin-proteide.

17. A process according to claim 12 wherein component a) is used in an amount from 0.5 to 10% based on the weight of the substrate.

18. A process according to claim 13 wherein the catalase is an iron porphyrin-proteide.

19. A process according to claim 13 wherein the bleaching is effected at a high alkaline pH and the bleaching bath is neutralized prior to application of the catalase.

20. A process according to claim 14 wherein the catalase is an iron porphyrin-proteide.

21. A process according to claim 16 wherein component a) is selected from hydrogen peroxide, sodium peroxide, sodium perborate and sodium percarbonate and the catalase is that derived from cow liver or from penicillin.

22. A process according to claim 17 wherein component a) is selected from hydrogen peroxide, sodium peroxide, sodium perborate and sodium percarbonate and the catalase is that derived from cow liver or from penicillin.

23. A process according to claim 18 wherein component a) is selected from hydrogen peroxide, sodium peroxide, sodium perborate and sodium percarbonate and the catalase is that derived from cow liver or from penicillin.

24. A process according to claim 19 wherein the catalase is an iron porphyrin-proteide.

25. A process according to claim 20 wherein component a) is selected from hydrogen peroxide, sodium peroxide, sodium perborate and sodium percarbonate and the catalase is that derived from cow liver or from penicillin.

26. A process according to claim 21 wherein component a) is used in an amount of 0.5 to 10%, based on the weight of the substrate.

27. A process according to claim 23 wherein component a) is used in an amount of 0.5 to 10%, based on the weight of the substrate.

28. A process according to claim 24 wherein component a) is selected from hydrogen peroxide, sodium peroxide, sodium perborate and sodium percarbonate and the catalase is that derived from cow liver or from penicillin.

29. A process according to claim 25 wherein component a) is used in an amount of 0.5 to 10%, based on the weight of the substrate.

30. A method for dyeing a textile substrate comprising i) bleaching the substrate by applying thereto an aqueous solution of component a), which is a peroxide or a peroxide-releasing product; ii) after bleaching, destroying excess component a) by applying a catalase to the substrate; and iii) dyeing the bleached and catalase-treated substrate with a dye selected from direct dyes, vat dyes, leuco vat dyes, sulfur dyes in reduced or pre-reduced form, coupling dyes, ice dyes, reactive dyes, acid dyes and metal complex dyes.

31. A process according to claim 30 wherein the dyeing is effected with a vat dye, a direct dye or a reactive dye.

32. A process according to claim 30 wherein the textile substrate is selected from natural and regenerated cellulose and mixtures thereof with each other or with polyester or polyacrylic fibers and natural and synthetic polyamide and mixtures thereof with each other or with cellulosic.

33. A process according to claim 30 which comprises bleaching and dyeing cellulosic material in one bath.

34. A process according to claim 33 which comprises bleaching and dyeing cellulosic material in one bath.

35. A process according to claim 33 wherein component a) is selected from hydrogen peroxide, sodium peroxide, sodium perborate and sodium percarbonate and the catalase is an iron porphyrin-proteide.

36. A process according to claim 35 wherein component a) is selected from hydrogen peroxide, sodium peroxide, sodium perborate and sodium percarbonate and the catalase is an iron porphyrin-proteide.

* * * * *